US008047621B2

(12) United States Patent
Walburn

(10) Patent No.: US 8,047,621 B2
(45) Date of Patent: Nov. 1, 2011

(54) FACE PLATE ALIGNMENT SYSTEM

(75) Inventor: William L. Walburn, Muncie, IN (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 749 days.

(21) Appl. No.: 12/117,506

(22) Filed: May 8, 2008

(65) Prior Publication Data

US 2009/0278431 A1 Nov. 12, 2009

(51) Int. Cl.
*A47B 88/00* (2006.01)

(52) U.S. Cl. ..... 312/348.4; 312/348.2; 312/265.5

(58) Field of Classification Search ..... 312/334.4, 312/348.1, 348.2, 330.1, 263, 265.5, 265.6; 403/116, 362
See application file for complete search history.

(56) References Cited

U.S. PATENT DOCUMENTS

| | | | | | |
|---|---|---|---|---|---|
| 2,316,389 | A | * | 4/1943 | Atkinson | 248/300 |
| 3,272,583 | A | * | 9/1966 | Averdieck | 312/334.38 |
| 3,273,952 | A | * | 9/1966 | Himelreich et al. | 312/348.1 |
| 3,666,341 | A | | 5/1972 | Little | 312/265.1 |
| 3,675,883 | A | * | 7/1972 | Holmes et al. | 248/251 |
| 4,180,298 | A | * | 12/1979 | Borgerson, Jr. | 312/242 |
| 4,230,382 | A | * | 10/1980 | Wenzlick et al. | 312/265.1 |
| 4,690,469 | A | | 9/1987 | Grass | 312/330 |
| 4,902,080 | A | * | 2/1990 | Berger | 312/348.4 |
| 4,995,683 | A | * | 2/1991 | Albiez | 312/348.4 |
| 5,046,861 | A | * | 9/1991 | Tarver | 384/20 |
| 5,069,411 | A | * | 12/1991 | Murphy | 248/476 |
| 5,076,723 | A | * | 12/1991 | Berger | 403/12 |
| 5,163,774 | A | * | 11/1992 | Lautenschlager | 403/245 |
| 5,364,181 | A | | 11/1994 | Scheible | 312/348.4 |
| 5,375,923 | A | | 12/1994 | Hall et al. | 312/348.4 |
| 5,505,554 | A | * | 4/1996 | Lautenschlager Horst et al. | 403/12 |
| 5,536,078 | A | * | 7/1996 | Novikoff | 312/195 |
| 5,549,378 | A | | 8/1996 | Grabher | 312/348.4 |
| 5,823,700 | A | * | 10/1998 | Poworoznek | 403/245 |
| 5,895,103 | A | * | 4/1999 | Huber | 312/348.4 |
| 5,951,133 | A | * | 9/1999 | Dittberner et al. | 312/348.4 |
| 6,390,576 | B1 | | 5/2002 | Walburn | 312/348.4 |
| 6,431,668 | B1 | * | 8/2002 | Reddicliffe | 312/334.5 |
| 6,561,605 | B1 | * | 5/2003 | Akers | 312/348.1 |

(Continued)

*Primary Examiner* — Darnell Jayne
*Assistant Examiner* — Hiwot Tefera
(74) *Attorney, Agent, or Firm* — Brinks Hofer Gilson & Lione

(57) ABSTRACT

A system for adjustably mounting the face plate of a drawer so that when the drawer is closed, the drawer face plate is flush with the adjacent drawer face plate and in a desired height, pitch, roll, lateral and skew position with respect to the front surface of the enclosure. The drawer face panel can be easily adjusted in an inward and outward direction, or a rearward and frontward direction, to compensate for differing degrees of tilt and skew of the drawer face panel with adjacent drawer face panels. A face plate alignment mounting system is provided and includes a lateral adjustment mechanism that engages a face plate and a drawer front panel, a first nut fastener, and an adjustable fastener. The first nut fastener preferably includes a head portion that is affixed to a drawer body and a shaft slidably engaged with a first bore of the drawer body. The first nut fastener shaft defines an opening with internal threads. The adjustable fastener has external threads engaged with the internal threads of the first nut fastener shaft opening. The adjustable fastener includes a first mechanism for adjusting the adjustable fastener in a frontward direction and a rearward direction to suitably adjust the distance between the face plate and said drawer front panel, which is preferably accessible at the rear surface of the drawer front panel.

17 Claims, 4 Drawing Sheets

U.S. PATENT DOCUMENTS

| | | | | |
|---|---|---|---|---|
| 6,616,479 | B1 * | 9/2003 | Jones | 439/567 |
| 6,715,953 | B2 * | 4/2004 | Oetlinger et al. | 403/231 |
| 6,854,817 | B1 * | 2/2005 | Simon | 312/334.6 |
| 6,893,199 | B2 * | 5/2005 | Michels | 411/340 |
| 6,948,788 | B1 | 9/2005 | Tai | 312/348.4 |
| 7,172,258 | B2 * | 2/2007 | Bisson et al. | 312/348.3 |
| 7,207,637 | B2 * | 4/2007 | Huang | 312/348.4 |
| 7,281,338 | B2 * | 10/2007 | Ziegmann et al. | 33/645 |
| 7,344,346 | B2 * | 3/2008 | Hsu | 411/551 |
| 7,419,343 | B2 * | 9/2008 | Nagayama | 411/179 |
| D596,424 | S * | 7/2009 | Noe et al. | D6/477 |
| 7,625,051 | B1 * | 12/2009 | Kim | 312/334.5 |
| 2002/0074914 | A1 * | 6/2002 | Shih | 312/334.4 |
| 2004/0207302 | A1 * | 10/2004 | Kao | 312/348.1 |
| 2006/0091768 | A1 * | 5/2006 | Walburn | 312/321.5 |
| 2010/0098513 | A1 * | 4/2010 | Wang | 411/343 |

* cited by examiner

FACE PLATE ALIGNMENT SYSTEM

BACKGROUND OF THE INVENTION

1. Field of the Invention

The present invention generally relates to pull-out cabinet slides, pantries and drawers that have face plates or fronts attached to match or otherwise complement the visual appearance of an adjacent cabinetry. The present invention particularly relates to a mounting system that facilitates the alignment of a face plate or drawer front.

2. Description of the Prior Art

Typically, when a drawer is installed into a cabinet, the face panel of the drawer may or may not be aligned with the adjacent cabinet in any or all of three dimensions. For both aesthetic and functional reasons, it is desirable that the face of the drawer be in alignment with the faces of any other drawers or cabinet doors that are also installed into the cabinet or adjacent cabinets. The drawer face panel is typically mounted onto the drawer itself, which is mounted onto a drawer slide, or it may be mounted directly to the drawer slide. In either case, the drawer slide is mounted into the cabinet.

One concern for alignment is the tilt of the drawer face panel in the roll direction with respect to adjacent drawer face panels. Tilt in the roll direction of a drawer face panel can result when the bottom of the face panel of a closed drawer may be in contact with the enclosure, but the top is not, yielding a gap between the top of the face and the cabinet. This not only promotes the likelihood of dust and debris entering the drawer through the gap, but also yields a displeasing appearance especially when the adjacent drawer face panels have differing degrees of tilt. Similarly, another concern for alignment is where the drawer face is skewed, i.e., where the left side of the drawer face panel touches against the enclosure when the drawer is closed, but the right side does not so touch. Again, a displeasing appearance is likely when the adjacent drawer face panels have differing degrees of skewing, and the likelihood of dust and debris entering the drawer through the gap is promoted. Other concerns for alignment which can lead to displeasing appearances are when the drawer face panel is not aligned properly in the height, lateral, or pitch directions with respect to adjacent drawer face panels.

In order to yield favorable alignment of the drawer face panel in the past, manufacturers have generally relied on tight tolerancing of the cabinet, the drawer, the drawer slide, and all the associated attachment hardware. These schemes, however, tend to be expensive due to the number of components involved and the tightness of the tolerances required to yield that favorable alignment. Furthermore, these schemes are not required for all cabinet industries. For example, in the low cost cabinet industry, tolerances are not expected to be held sufficiently tight, yet poor drawer face alignment is in fact more common. Presently, various schemes for adjustment of the drawer face position are available. These schemes provide an assortment of components or features, which allow for adjustment of the front panel without requiring expensively tight tolerances. However, most of these schemes are accomplished using the time consuming trial and error method, i.e., an adjustment is made, followed by closing the drawer and checking its position, followed by another adjustment, with this process being repeated until a suitable adjustment has been obtained. Thus, there remains a need for adjustment and alignment of the drawer face panel with an adjacent drawer face panel that can be performed easily, less expensively, and in less time. There also remains a need to adjust easily the drawer face panel in an inward and an outward direction, or a rearward and frontward direction, to compensate for differing degrees of tilt and skew of the drawer face panel with adjacent drawer face panels.

SUMMARY OF THE INVENTION

The present invention relates generally to drawers used in cabinets or other enclosures, and more specifically to a means for adjustably mounting the face plate of a drawer so that when the drawer is closed, the drawer face plate is in flush contact with an adjacent drawer face plate and in desired height, pitch, roll, lateral and skew positions with respect to the front surface of the enclosure.

In one embodiment of the present invention, a face plate alignment mounting system for adjusting a face plate of a drawer is provided. The drawer generally has a drawer body including a front panel that has a front surface and a rear surface. The face plate alignment mounting can include a lateral adjustment means engaging the face plate and the drawer front panel. The face plate alignment mounting can also include a first nut fastener and an adjustable fastener. The first nut fastener preferably includes a head portion affixing the first nut fastener to the drawer body and a shaft slidably engaging a first bore of the drawer body. The first nut fastener shaft defines an opening with internal threads. The adjustable fastener can have external threads threadably engaging the internal threads of the shaft opening of the first nut fastener. The adjustable fastener includes a first means for adjusting the adjustable fastener in a frontward direction and a rearward direction to suitably adjust the distance between the face plate and the drawer front panel. The first means is preferably accessible at the rear surface of the drawer front panel.

In another embodiment of the present invention, a face plate alignment mounting system for permitting adjustment of the face plate relative to a perimeter of an enclosure and to adjacent enclosures is provided. The enclosure generally includes an opening defined by the perimeter. The drawer face plate has an outer portion dimensioned to overlap the perimeter. The drawer generally has a drawer body including a front panel that has a front surface and a rear surface, a rear panel, and outer lateral extremities connecting the front and rear panels. A drawer slide assembly having a fixed portion and a movable portion can also be provided. The face plate alignment mounting system can be positioned at each corner of the drawer front panel and can include a lateral adjustment means engaging the face plate and the drawer front panel. The face plate alignment mounting system can also include a T-nut fastener and an adjustable fastener. The T-nut fastener can include a head portion with self-piercing prongs for affixing the T-nut fastener to the drawer body and a shaft slidably engaging the first bore of the drawer body, with the shaft extending from the head portion. The T-nut fastener shaft can define an opening with internal threads. The adjustable fastener can have external threads threadably engaging the internal threads of the shaft opening of the T-nut fastener. The adjustable fastener includes a first means for adjusting the adjustable fastener in a frontward direction and a rearward direction to suitably adjust the distance between the face plate and the drawer front panel, with the first means being accessible at the rear surface of the drawer front panel.

The face plate alignment mounting system of another embodiment of the present invention can further include a threaded fastener that includes a shaft having a first portion with external threads engaging the drawer body through a second bore of the drawer body. The second bore is preferably perpendicular to the drawer front panel. The threaded fastener shaft can also include a second portion extending from the first portion and outward passed the drawer front panel, with the second portion engaging the lateral adjustment means. A head portion can also be provided with the threaded fastener, which can extend from the threaded fastener shaft. The face plate alignment mounting system can also include a second nut fastener that has internal threads for threadably engaging the external threads of the threaded fastener shaft at the rear surface of the drawer front panel. When the second nut fastener is threadably engaged sufficiently tight with the external threads of the threaded fastener shaft, the drawer face plate can be prevented from adjusting in a lateral direction. The face plate alignment mounting system can also include a washer for receiving the threaded fastener shaft and contacting the second nut fastener and the drawer front panel at the rear surface of the drawer front panel. The lateral adjustment means preferably includes a support bracket. The support bracket can include a slot and two parallel edges curved substantially perpendicular. The curved edges can slidably engage with two laterally running, parallel grooves in the drawer front panel for adjusting the face plate in a lateral direction.

A process for adjusting a drawer face plate relative to a drawer and adjacent drawers to insure correct distance between the face plate and a drawer front panel is also provided. The process can includes the steps of providing a drawer having a face plate and a front panel having a front surface and a rear surface, and a face plate alignment mounting system of the aforementioned embodiments of the present invention. The first nut fastener shaft can be inserted and slidably engaged with the first bore of the drawer body. The first nut fastener head can be affixed to the drawer body. Another step can include threadably engaging the adjustable fastener external threads with the internal threads of the opening of the first nut fastener shaft. The adjustable fastener can be movably adjusted fully in the rearward direction until the lateral adjustment means is attached. Another step can include engaging the lateral adjustment means to the drawer front panel, and engaging the drawer face plate to the lateral adjustment means. The adjustable fastener can be movably adjusted in the frontward direction with a tool at the rear surface of the drawer front panel to a desired distance between the drawer face plate and the drawer front panel.

One feature of the present is that the adjustment and alignment of the drawer face panel relative to an adjacent drawer face panel can be performed easily, less expensively, and in less time. The drawer face panel can be easily adjusted in an inward and an outward direction, or a rearward and frontward direction, to compensate for differing degrees of tilt and skew of the drawer face panel with adjacent drawer face panels.

Other features and advantages of the present invention will become apparent to those skilled in the art from the following disclosure of preferred embodiments of the present invention exemplifying the best mode of practicing the invention. The following disclosure references the accompanying drawings illustrating the preferred embodiments.

DESCRIPTION OF PREFERRED EMBODIMENTS

Figure 1A:
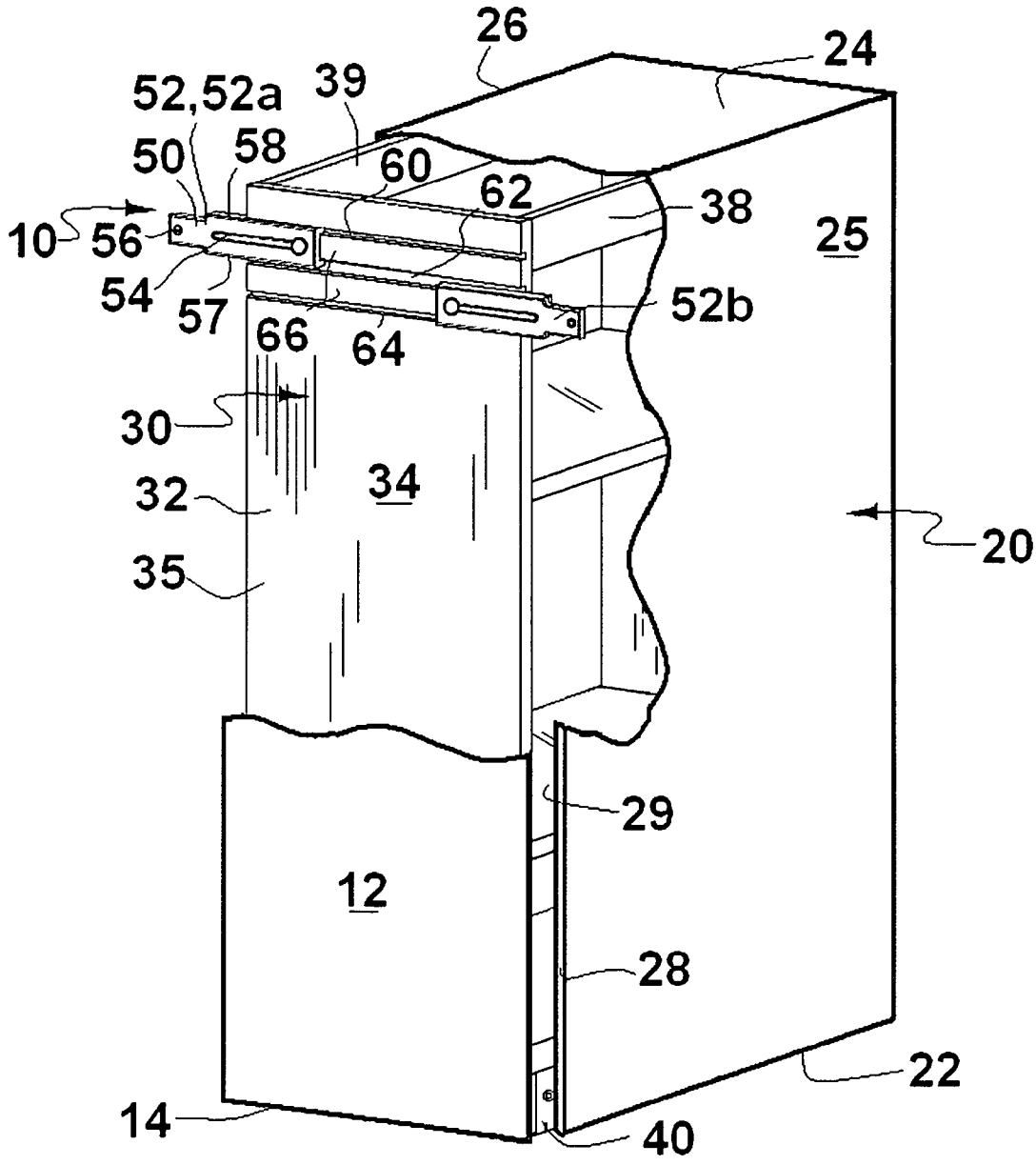
FIG. 1A is a perspective front view of a face plate alignment mounting system attached to a drawer and a drawer face plate relative to an enclosure.
Figure 1B:
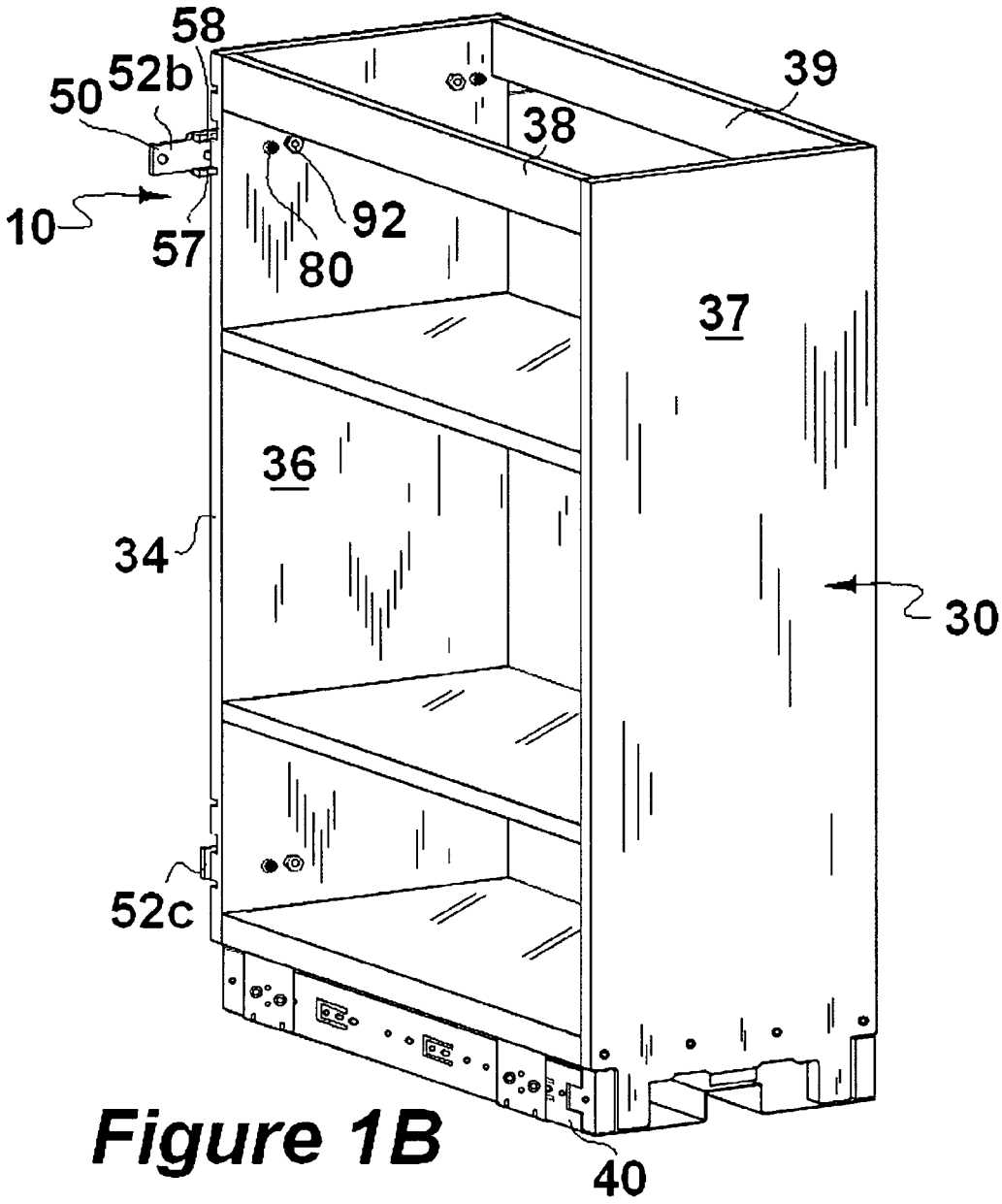
FIG. 1B is a perspective rear view of the face plate alignment mounting system attached to a drawer in FIG. 1A, depicted without the drawer face plate and the enclosure.

Referring to FIG. 1A, a face plate alignment mounting system 10 is depicted for adjustably mounting a drawer face plate 12 having an outer portion 14 into a desired position relative to an enclosure 20. FIG. 1B is a perspective rear view of the face plate alignment mounting system 10 attached to a drawer 30, depicted without the drawer face plate 12 and the enclosure 20. While the term "door" is often used in the industry to refer to any panel-like structure having a vertical dimension exceeding the horizontal dimension, in the present document the term "drawer" is used to refer to any structure that is received in a sliding fashion, instead of a pivoting fashion, in a cabinet or other similar structure, regardless of its relative vertical and horizontal dimensions. It is to be understood that the enclosure 20 may be a kitchen or bathroom cabinet, a paper file cabinet, a tool chest, an industrial or consumer storage cabinet, or any of a variety of enclosures used for housing any of a variety of objects. The enclosure 20 incorporates an enclosure floor 22 and a ceiling 24 connected by enclosure side walls 25, 26, which define a perimeter 28 around an opening 29. The drawer 30 includes a drawer body 32 including a front panel 34 having a front surface 35 and a rear surface 36 and a rear panel 37 connected to the front panel 34 by outer lateral extremities 38, 39, as shown in FIGS. 1A and 1B. The drawer face plate 12 may be a solid piece of wood, a composite structure comprising a variety of materials, or may be of frame and panel construction, including a face frame and a decorative panel. The drawer face plate 12 can have similar dimension as the drawer front panel 34. Alternatively, the drawer face plate 12 can have an outer portion 14 dimensioned to overlap the perimeter 28 of the enclosure 20. A conventional drawer slide assembly 40 comprising a left drawer slide rail and a right drawer slide rail is installed into the enclosure 20 for selective withdrawal of the drawer 30. Left drawer slide rail and right drawer slide rail each comprise both a movable portion and a fixed portion.

The drawer face plate 12 is secured to the drawer front panel 34 by use of a lateral adjustment means 50 for adjusting the drawer face plate 12 in a lateral direction. The lateral adjustment means 50 preferably includes a support bracket 52 comprising a slot 54 to engage a fastener, an aperture 56, and at least one of two parallel edges 57, 58 curved substantially perpendicular to the drawer front panel 34. The aperture 56 can be used to connect the support bracket 52 to the drawer face plate 12. Typically, pre-drilled holes are provided in a rear side 13 of the drawer face plate 12 to be aligned with the support bracket aperture 56. When mounting the drawer face plate 12 to the support bracket 52, a fastener, typically a wood screw, is threadably engaged with the support bracket 52 and the drawer face plate 12 through the aperture 56.

Figure 2B:
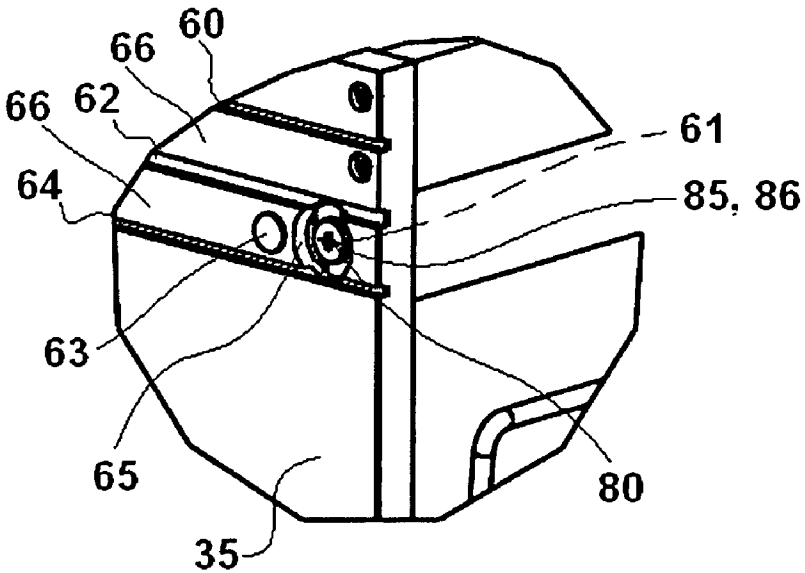
FIG. 2B is a perspective, magnified view of the face plate alignment mounting system attached to one corner of the drawer, depicting a second bore in relation to the adjustable fastener shown without the lateral adjustment means.
Figure 2A:
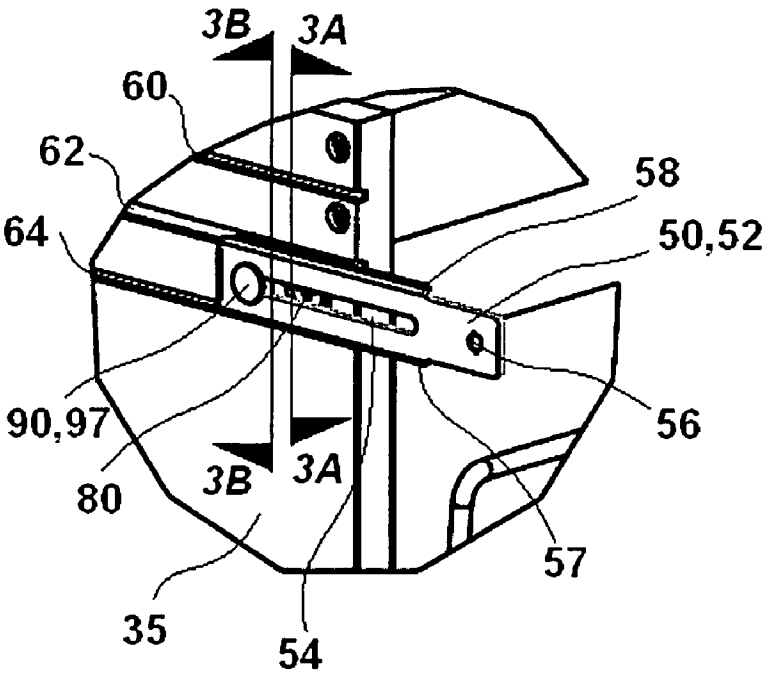
FIG. 2A is a perspective, magnified view of the face plate alignment mounting system attached to one corner of the drawer, depicting a lateral adjustment means, shown as a support bracket, and a threaded fastener in relation to an adjustable fastener.

At least one of the curved edges 57, 58 can provide a support means for inserting into and slidably engaging at least one of two parallel grooves 60, 62, 64 in the drawer front panel 34, as shown in FIGS. 1A, 2A and 2B. Preferably, three laterally running, parallel grooves are positioned at the upper portion of the drawer 30 and three more laterally running, parallel grooves are positioned at the bottom portion of the drawer 30. The drawer 30 can also have multiple support brackets 52*a*, 52*b*, 52*c*. Referring to the upper portion, the support bracket 52*a* of one corner can slidably engage with a top groove 60 and a middle groove 62 of the three grooves, and the support bracket 52*b* of the laterally adjacent corner can slidably engage with the middle groove 62 and a bottom groove 64 of the three grooves. In between the grooves 60, 62 or 62, 64 is a web 66 that connects each groove. The web 66 is typically where bores or openings are positioned. Three of four support brackets 52*a*, 52*b*, 52*c* are shown in some fashion in FIGS. 1A and 1B, with one bracket in the each of the four corners of the drawer front panel 34. Two support brackets 52*a*, 52*b* are located on the upper portion of the drawer front panel 34 and one of two support brackets 52*c* is shown to be located on the bottom portion of the drawer front panel 34.

Referring to FIGS. 2A, 2B, 3A, and 3B, the drawer face plate 12 is adjusted with the face plate alignment mounting system 10 of the present invention. The face plate alignment mounting system 10 can include the lateral adjustment means 50 described herein, a first nut fastener 70, and an adjustable fastener 80. The first nut fastener 70 is a fastener configured to affix to a surface through a bore and adapted to receive another fastener that can translate relative to the first nut fastener 70. Preferably, the first nut fastener 70 is a T-nut fastener 71, or its equivalents. The T-nut fastener 71 includes a head portion 72 with self-piercing prongs 73 that affix the T-nut fastener 71 to the front panel 34 of the drawer body 32. Extending from the head portion 72 of the T-nut fastener 71 is a shaft 74 that slidably engages with a first bore 61 of the front panel 34 of the drawer body 32. The shaft 74 defines an opening 75 within the interior of the shaft 74, the opening 75 having internal threads 76 for receiving the adjustable fastener 80. The first bore 61 can also have a recessed portion or an indentation 77, axially aligned with the first bore 61. The indentation 77 can have a depth greater than the thickness of the head portion of the first nut fastener 70, the thickness of the head 86 of the adjustable fastener 80, or both, and can have a cross-sectional area that is slightly larger than the cross-sectional area of first nut fastener 70. Preferably, the depth of the indentation 77 is greater than the thickness of the head portion of the first nut fastener 70 and the thickness of the head 86 of the adjustable fastener 80 so as to not contribute to interference with the lateral adjustment means 50.

Figure 3B:
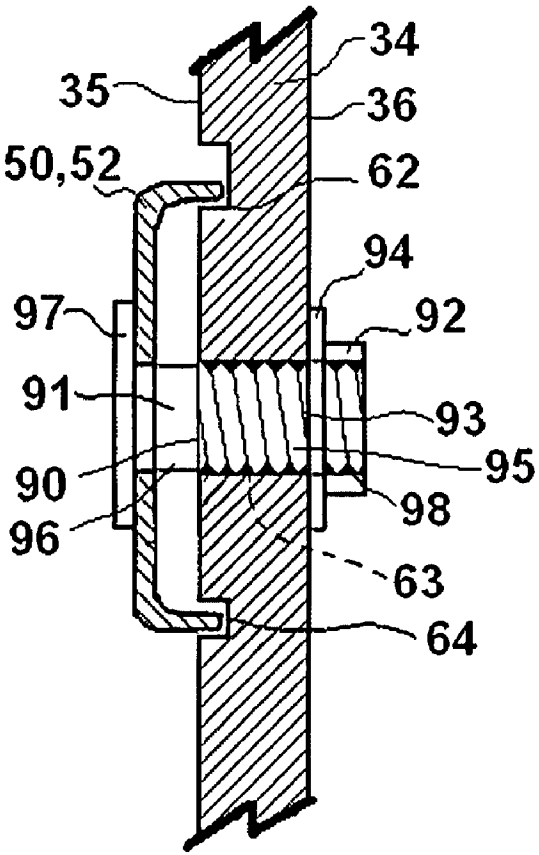
FIG. 3B is a cross-sectional view taken along line 3B-3B of FIG. 2A depicting the threaded fastener in relation to a second nut fastener, shown without the drawer face plate contacting the lateral adjustment means.
Figure 3A:
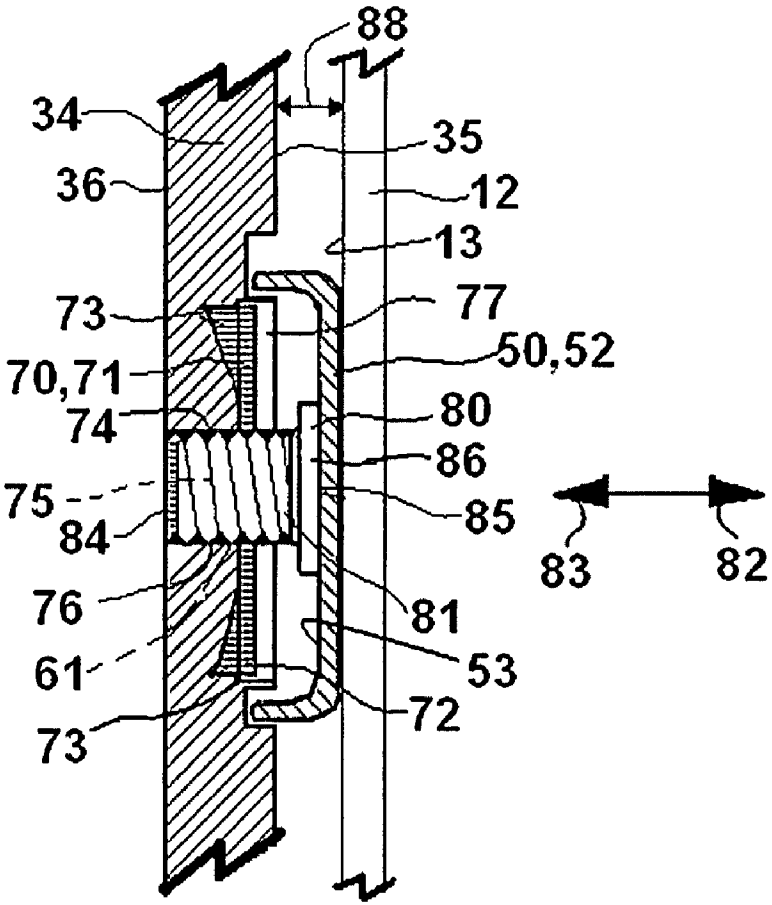
FIG. 3A is a cross-sectional view taken along line 3A-3A of FIG. 2A depicting a first nut fastener, shown as a T-nut fastener, in relation to the adjustable fastener, the adjustable fastener being in an extended position pressing against the lateral adjustment means and the drawer face plate.

Referring to FIG. 3A, the adjustable fastener 80 can include external threads 81 for threadably engaging the internal threads 76 of the shaft opening 75 of the first nut fastener 70. The adjustable fastener 80 can have more than one means for adjusting the position in a frontward direction 82 and a rearward direction 83 relative to the first nut fastener 70. Preferably, the adjustable fastener 80 has at least a first means 84 for adjusting the adjustable fastener 80, which is accessible at the rear surface 36 of the drawer front panel 34. Alternatively, the adjustable fastener 80 can have a second means 85 for adjusting the adjustable fastener 80, which is accessible at the front surface 35 of the drawer front panel 34 when the drawer face plate 12 is unattached to the lateral adjustment means 50. The first means 84, the second means 85, or both can include a cross or crosshead for engaging a Phillips head screwdriver, a slot for engaging a slotted or flathead screwdriver, a hex-head for engaging a wrench or nut driver, a hex-indentation for engaging a hex or Allen wrench, or any other screw driver types known in the art. The adjustable fastener 80 is preferably positioned for the head 86 of the adjustable fastener 80 to engage the rearward facing side 53 of the support bracket 52 by using the appropriate tool to advance the adjustable fastener 80 in the frontward direction 82. Once engaged, the adjustable fastener 80 can be moved in the frontward direction 82 or in the rearward direction 83 to suitably adjust the distance 88 between the drawer face plate 12 and the drawer front panel 34, making the drawer face plate 12 flush with an adjacent face plate 12 or drawer front panel 34.

Generally referring to FIGS. 2A, 2B, and 3A, and specifically to FIG. 3B, the drawer face plate alignment mounting system 10 can also include a threaded fastener 90, a second nut fastener 92, and a washer 94. The threaded fastener 90 can include a shaft 91 having a first portion 93 with external threads 95 that can engage the front panel 34 of the drawer body 32 through a second bore 63. Preferably, the centers of the first and second bores 61, 63 are aligned and parallel to the bottom edge of the drawer body 32 and located in a web 66 that connects the grooves, as shown in FIG. 2B. The first bore 61 and the second bore 63 are preferably perpendicular to the drawer front panel 34. The threaded fastener shaft 91 can also include a second portion 96 extending from the first portion 93 and outward passed the drawer front panel 34. Preferably, the second portion 96 of the threaded fastener shaft 91 slidably engages the support bracket slot 54. The threaded fastener 90 also includes a head portion 97 extending outwardly from the threaded fastener shaft 91. The threaded fastener head portion 97 can have a larger cross-sectional area than a cross-sectional area of the support bracket slot 54. The threaded fastener 90 can comprise a bolt, screw, or a customized screw.

Referring to FIG. 5B, the second nut fastener 92 can include internal threads 98 for threadably engaging the external threads 95 of the threaded fastener 90, and can be accessible from the rear surface 36 of the drawer front panel 34. Preferably, the second nut fastener 92 is a self-locking nut that can be adjusted with a wrench or equivalent tool. By inserting the threaded fastener 90 through the support bracket slot 54 and through the second bore 63, the second nut fastener 92 can threadably engage with the external threads 95 of the threaded fastener 90. The drawer face plate 12 can be prevented from adjusting in the lateral direction by sufficiently tightening the second nut fastener 92 with an appropriate tool. As the second nut fastener 92 is tightened, the threaded fastener head portion 97 frictionally contacts and forces the support bracket 52 in the rearward direction 83. A washer 94 can also be installed at the rear surface 36 of the drawer front panel 34 and around the threaded fastener 90 for contacting the second nut fastener 92 and the drawer front panel 34.

Attachment of the drawer face plate 12 and the face plate alignment mounting system 10 is further explained, with general reference to all of the figures. In conventional installations, the face plate alignment mounting system 10 can be attached to each corner of the drawer front panel 34. The grooves 60, 62, 64, the bores 61, 63, and the indentation 65 can be typically machined or cut into the drawer body 32 before installation. The face plate alignment mounting system 10 can be installed by affixing the first nut fastener 70 to the drawer body 32 through the first bore 61 of the drawer body 32. When a T-nut fastener 71 is used, the T-nut fastener 71 can be affixed to the drawer body 32 by applying force to the T-nut fastener head portion 72 with a hammer or the like, thereby causing the self-piercing prongs 73 to penetrate the area surrounding the first bore 61. The external threads 81 of the adjustable fastener 80 can be threadably engaged with the internal threads 76 of the shaft opening 75 of the first nut fastener 70 by rotating the adjustable fastener 80 with an appropriate tool. The adjustable fastener 80 should be recessed within the first nut fastener 70 until the drawer face plate 12 is attached. At least one of the curved edges 57, 58 of the support bracket 52 can then be engaged with the appropriate grooves 60, 62, 64, and the slot 54 of the support bracket 52 can be aligned with at least the second bore 63 of the drawer body 32. Once aligned, the threaded fastener 90 can be inserted through the support bracket slot 54 and through the second bore 63, and threadably engaged with the second nut fastener 92 at the rear side 36 of the drawer front panel 34. The second nut fastener 92 should not fully tightened until the drawer face plate 12 is completely adjusted. After all of the necessary support brackets 52 are attached, the drawer face plate 12 can then be attached. As mentioned previously, pre-drilled holes can be typically provided at the rear side 13 of the drawer face plate 12. The drawer face plate 12 holes can be aligned with the support bracket aperture 56 where a fastener can be attached to affix the drawer face plate 12 to the support bracket 52.

From the foregoing, it can be seen that the invention allows a simple and expedient means of positioning the drawer face plate 12 relative to the enclosure 20. Unlike other means of positioning such panels, it will be appreciated by those skilled in the art that there is no need for trial and error adjustment, i.e., no need to make an initial assessment of the drawer face plate 12 position, make an adjustment, check for desired position with the door closed, readjust, recheck, and readjust. The invention allows for a single act of positioning of the drawer face plate 12, saving installation time and effort, which reduces labor cost and enhances customer satisfaction. In addition, it is important to note that the invention allows for adjustment in all directions. These advantages of the invention are the result of the threaded fastener 90, the support brackets 52 and grooves 60, 62, 64 which allow for lateral, height, and pitch, and the result of the adjustable fastener 80, which allows for roll and skew adjustment of the drawer face plate 12.

Here, the term, height, refers to adjustment in the vertical direction, i.e., up and down; the term, pitch, refers to the adjustment required to prevent the drawer face plate 12 from leaning to the left or to the right, i.e., as if pivoting the drawer face plate 12 about a line perpendicular to and passing through a center of the drawer face plate 12; and the term, roll, pertains to the adjustment necessary to render the drawer face plate 12 in contact with enclosure 20 at both upper and lower extremities of the drawer face plate 12, i.e., as if pivoting the drawer face plate 12 about a horizontal line which passes through the center of that drawer face plate 12. The term, lateral, refers to adjustment of the drawer face plate 12 in a horizontal direction, i.e., to the left and to the right, while the term, skew, pertains to the adjustment required to render the drawer face plate 12 in contact with the enclosure 20 at both left and right extremities of the drawer face plate 12, i.e., as if pivoting the drawer face plate 12 about a vertical line that passes through the center of that drawer face plate 12.

Roll and skew adjustment of the drawer face plate 12 can be accomplished by adjustment of the appropriate adjustable fasteners 80 preferably positioned at each corner of the drawer front panel 34. For example, if one corner of the drawer face plate 12 is not flush with the adjacent corner of the adjacent drawer face plate in the frontward direction 82, the adjustable fastener 80 can be rotatably moved to a desired position by an appropriate tool to make the corners flush. Accordingly, the left and right side and the upper and bottom side of the drawer face plate 12 can be moved in the frontward direction 82 and rearward direction 83 by the adjustable fastener 80.

Height, pitch, and lateral position adjustment of the drawer face plate 12 can be accomplished by adjustment of the appropriate threaded fasteners/second nut fasteners 90, 92 and the support brackets 52 working in conjunction. For example, if the drawer face plate 12 is positioned off-center to the left relative to the adjacent drawer face plate, the threaded fastener 90 can be tightened to only finger tight, and the entire drawer face plate 12 can be moved laterally to compensate for the off-centeredness. Similarly, the adjustment of the height and pitch of the drawer face plate 12 can be adjusted. After adjustment of the drawer face plate 12 to a desired orientation, the second nut fastener 92 can be tightened around the threaded fastener 90.

From the forgoing description of the structure and operation of a preferred embodiment of the present invention, it will be apparent to those skilled in the art that the present invention is susceptible to numerous modifications and embodiments within the ability of those skilled in the art and without exercise of the inventive facility. Accordingly, the scope of the present invention is defined as set forth of the following claims.

What is claimed is:

1. A face plate alignment mounting system to adjust a face plate of a drawer, the drawer having a drawer body including a front panel having a rear surface and a front surface having at least two laterally running, parallel grooves, the system comprising:

a lateral adjustment means engaging the face plate and comprising a first support bracket having two parallel edges curved substantially perpendicular to and slidably engaging two grooves of said drawer front panel and a second support bracket having two parallel edges curved substantially perpendicular to and slidably engaging two grooves of said drawer front panel to adjust the face plate in a lateral direction relative to said drawer front panel, the first and second support brackets positioned at two different corners of the drawer front panel;

a first nut fastener including a head portion and a shaft portion, the head portion affixing the first nut fastener to said drawer body and the shaft portion slidably engaging a first bore of said drawer body and defining an opening with internal threads;

an adjustable fastener having external threads threadably engaging the internal threads of the opening of the shaft of the first nut fastener, and having a first and a second means for adjusting the adjustable fastener in a frontward direction and a rearward direction perpendicular to the front surface of the front panel of the drawer body to suitably adjust the distance between the face plate and at least one corner of said drawer front panel, the first and second means positioned at opposite ends of the adjustable fastener, the first means accessible at the rear surface of said drawer front panel.

2. The face plate alignment mounting system of claim 1, wherein each support bracket of the lateral adjustment means further comprises a slot.

3. The face plate alignment mounting system of claim 2 further comprising:

a threaded fastener including a shaft having a first portion with external threads engaging said drawer body through a second bore of said drawer body, a second portion slidably engaging one of the support bracket slots to adjust said face plate in a lateral direction, and a head portion attached to the threaded fastener shaft having a larger cross-sectional area than a cross-sectional area of the support bracket slot; and a second nut fastener having internal threads threadably engaging the external threads of the threaded fastener shaft at the rear surface of said drawer front panel, wherein the second nut fastener is threadably engaged sufficiently tight with the external threads of the threaded fastener shaft to prevent the face plate from adjusting in the lateral direction.

4. The face plate alignment mounting system of claim 1, wherein the first nut fastener is a T-nut fastener, the T-nut fastener including a head portion with self-piercing prongs affixing the T-nut fastener to said drawer body and a shaft slidably engaging the first bore of said drawer body, the shaft extending from the head portion and defining an opening with internal threads to receive the adjustable fastener.

5. The face plate alignment mounting system of claim 1, wherein the first means for adjusting the adjustable fastener in the frontward and rearward directions comprises a cross to be engaged with a Phillips head screwdriver.

6. The face plate alignment mounting system of claim 1, wherein the first bore is located in at least one corner of said drawer front panel.

7. The face plate alignment mounting system of claim 6, wherein the first bore is located in a web between two of the grooves in said drawer front panel and the support bracket extends laterally beyond an edge of the front surface of the front panel of the drawer body.

8. The face plate alignment mounting system of claim 1 further comprising:

a threaded fastener including a shaft having a first portion with external threads engaging said drawer body through a second bore of said drawer body, a second portion slidably engaging one of the first or second support brackets, and a head portion attached to the threaded fastener shaft; and a second nut fastener having internal threads threadably engaging the external threads of the threaded fastener shaft at the rear surface of said drawer front panel, wherein the second nut fastener is threadably engaged sufficiently tight with the external threads of the threaded fastener shaft to prevent the face plate from adjusting in the lateral direction.

9. A face plate alignment mounting system to adjust the face plate relative to a perimeter of an enclosure and to adjacent enclosures, the enclosure having an opening defined by the perimeter, a drawer face plate having an outer portion dimensioned to overlap the perimeter, a drawer having a drawer body including a front panel having a front surface and a rear surface, a rear panel, outer lateral extremities connecting the front and rear panels, and a drawer slide assembly having a fixed portion and a movable portion, the system positioned at each corner of the drawer front panel and comprising:

a lateral adjustment means engaging the face plate and at least three laterally running, parallel grooves in the front surface of said drawer front panel, the lateral adjustment means comprising first and second support brackets each having a slot and two parallel edges curved substantially perpendicular to and slidably engaging two of the three grooves in said drawer front panel, the first support bracket slidably engaging a top groove and a middle groove and the second support bracket slidably engaging the middle groove and a bottom groove to adjust the face plate in a lateral direction relative to the front surface of the front panel of the drawer body, the first and second support brackets positioned at adjacent corners of the drawer front panel;

a T-nut fastener including a head portion and a shaft portion, the head portion comprising self-piercing prongs affixing the T-nut fastener to said drawer body and the shaft portion slidably engaging a first bore of said drawer body, the shaft portion extending from the head portion and defining an opening with internal threads; and an adjustable fastener having external threads threadably engaging the internal threads of the opening of the shaft portion of the T-nut fastener, and having a first means for adjusting the adjustable fastener in a frontward direction and a rearward direction perpendicular to the front surface of the front panel of the drawer body to suitably adjust the distance between the face plate and at least one corner of said drawer front panel, the first means accessible at the rear surface of said drawer front panel;

wherein at least a portion of the lateral adjustment means extends laterally beyond an edge of the front surface of the front panel of the drawer body.

10. The face plate alignment mounting system of claim 9, wherein one of the first or second support brackets of the lateral adjustment means is positioned perpendicular to the adjustable fastener and encloses the adjustable fastener threadably engaged with the T-nut fastener, the head portion of the T-nut fastener affixed to the front surface of the front panel of the drawer body, and the adjustable fastener positioned to engage a rearward facing side of the first or second support bracket.

11. The face plate alignment mounting system of claim 9, wherein the adjustable fastener further comprises a second means for adjusting the adjustable fastener in a frontward direction and a rearward direction, the first and second means positioned at opposite ends of the adjustable fastener and comprising a cross to be engaged with a Phillips head screwdriver.

12. The face plate alignment mounting system of claim 9 further comprising:

a threaded fastener including a shaft having a first portion with external threads engaging said drawer body through a second bore of said drawer body, the second bore perpendicular to said drawer front panel, a second portion extending from the first portion and outward beyond said drawer front panel, the second portion engaging the lateral adjustment means for adjusting said face plate in a lateral direction, and a head portion extending from the threaded fastener shaft;

a second nut fastener having internal threads to threadably engage the external threads of the threaded fastener shaft at the rear surface of said drawer front panel, wherein the second nut fastener is threadably engaged sufficiently tight with the external threads of the threaded fastener shaft to prevent said face plate from adjusting in a lateral direction; and a washer receiving the threaded fastener shaft and contacting the second nut fastener and said drawer front panel at the rear surface of said drawer front panel.

13. The face plate alignment mounting system of claim 9, wherein the centers of the first and second bores are aligned with and parallel to one another and are located in a web connecting two of the three grooves in the drawer front panel.

14. The face plate alignment mounting system of claim 9, wherein the middle groove and one of the two other grooves define a web therebetween where the first and second bores are positioned, the system further comprising an indentation axially aligned with the first bore, receiving the head portion of the T-nut fastener, the indentation having a cross-sectional area sized to contain the T-nut fastener head portion.

15. The face plate alignment mounting system of claim 14, wherein each support bracket is positioned perpendicular to the adjustable fastener and enclosing the adjustable fastener threadably engaged with the T-nut fastener, the adjustable fastener positioned to engage a rearward facing side of the support bracket.

16. The face plate alignment mounting system of claim 14, wherein the indentation has a depth greater than the thickness of the T-nut fastener head portion.

17. A process for adjusting a drawer face plate relative to a drawer and adjacent drawers to insure correct distance between the face plate and a drawer front panel, the process comprising the steps of:

(a) providing (i) a drawer having a face plate and a front panel having a front surface and a rear surface; and (ii) a face plate alignment mounting system comprising a lateral adjustment means for adjusting the face plate in a lateral direction relative to the front surface of the front panel of the drawer body, the lateral adjustment means engaging the face plate and said drawer front panel; a first nut fastener including a head portion and a shaft portion, the head portion configured to affix the first nut fastener to said drawer body and the shaft portion configured to slidably engage a first bore of said drawer body and defining an opening with internal threads; an adjustable fastener having external threads to threadably engage the internal threads of the shaft opening of the first nut fastener, and having a first means for adjusting the adjustable fastener in a frontward direction and a rearward direction perpendicular to the front surface of the front panel of the drawer body to suitably adjust the distance between the face plate and said drawer front panel to adjust at least one of a roll and a skew of the face plate, the first means accessible at the rear surface of said drawer front panel;

(b) inserting and slidably engaging the first nut fastener shaft with the first bore of the drawer body;

(c) affixing the first nut fastener head portion to the drawer body;

(d) threadably engaging the adjustable fastener external threads with the internal threads of the opening of the first nut fastener shaft;

(e) movably adjusting the adjustable fastener fully in the rearward direction;

(f) engaging a first support bracket of the lateral adjustment means with a top and a middle laterally running, parallel grooves formed in the front surface of the drawer front panel;

(g) engaging a second support bracket of the lateral adjustment means with the middle and a bottom laterally running, parallel grooves formed in the front surface of the drawer front panel;

(h) engaging the drawer face plate with the lateral adjustment means; and (i) movably adjusting the adjustable fastener in the frontward direction with a tool at the rear surface of the drawer front panel to a desired distance between the drawer face plate and at least one corner of the drawer front panel.

* * * * *